US006696798B2

(12) United States Patent
Nishimoto et al.

(10) Patent No.: US 6,696,798 B2
(45) Date of Patent: Feb. 24, 2004

(54) BALLAST CIRCUIT FOR OPERATING A DISCHARGE LAMP

(75) Inventors: Kazuhiro Nishimoto, Kashihara (JP); Katsunobu Hamamoto, Neyagawa (JP); Hiromitsu Mizukawa, Katono (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/362,689

(22) PCT Filed: Sep. 5, 2001

(86) PCT No.: PCT/JP01/07680

§ 371 (c)(1),
(2), (4) Date: Mar. 5, 2003

(87) PCT Pub. No.: WO02/21884

PCT Pub. Date: Mar. 14, 2002

(65) Prior Publication Data

US 2003/0168997 A1 Sep. 11, 2003

(30) Foreign Application Priority Data

Sep. 6, 2000 (JP) ..... 2000-270458

(51) Int. Cl.[7] ..... H05B 37/02
(52) U.S. Cl. ..... 315/224; 315/307; 315/DIG. 4
(58) Field of Search ..... 315/224, 307, 315/DIG. 4

(56) References Cited

U.S. PATENT DOCUMENTS

| | | |
|---|---|---|
| 5,925,990 A | 7/1999 | Crouse et al. |
| 6,023,132 A | 2/2000 | Crouse et al. |

FOREIGN PATENT DOCUMENTS

| | | |
|---|---|---|
| DE | 34 01 653 | 7/1984 |
| EP | 0 681 414 | 11/1995 |
| JP | 11-031594 | 2/1999 |
| WO | 99 34647 | 7/1999 |

*Primary Examiner*—David Vu
(74) *Attorney, Agent, or Firm*—Oblon, Spivak, McClelland, Maier & Neustadt, P.C.

(57) ABSTRACT

A ballast circuit for a discharge lamp capable of protecting the circuit when the lamp reaches its end of life with a cost effective circuit arrangement. The circuit includes a DC voltage sensing network for sensing a DC voltage which appears as a consequence of the lamp reaching its end of life. Upon the sensed DC voltage exceeding a threshold, a control is made to limit or stop supplying an output power to the lamp for protecting the ballast circuit from an otherwise generating excessive current. The sensing network is composed of a DC sensing capacitor and a resistor which are connected in circuit outside of a resonant circuit responsible for generating a high frequency voltage to operate the lamp. Thus, the DC sensing capacitor can be kept free from the high voltage generated by the resonant circuit and be of less cost for reducing a manufacturing cost.

5 Claims, 4 Drawing Sheets

BALLAST CIRCUIT FOR OPERATING A DISCHARGE LAMP

TECHNICAL FIELD

The present invention relates to a ballast circuit for operating a discharge lamp, and more particularly to an electronic discharge lamp ballast having a circuit protection against an end of lamp-life condition.

BACKGROUND ART

In order to protect an electronic ballast from an excessive current flowing through the ballast circuit as a result of the lamp reaching its end of life condition, the prior art electronic ballasts are designed to detect the end of lamp life and restrict the ballast operation once the end of life is detected. A typical example of the electronic ballast having such protection is disclosed in Japanese patent publication No JP11-31594. The ballast of this publication utilizes a voltage detector which detects a lamp voltage, i.e., a voltage across the lamp for determination of whether the lamp voltage exceeds a predetermined threshold as indicative of that the lamp reaches the end of life. However, the detector of the ballast is required to withstand a high voltage applied at the start of the lamp and therefore has to adopt resistors and like elements capable of withstanding the high-voltage, resulting in increased cost of the ballast and a somewhat bulky assembly. The problem is solved in another prior art, i.e., U.S. Pat. No. 5,925,990 in which the detector is arranged to detect a voltage across a capacitor which is inserted in the ballast in series with the discharge lamp. Although this prior art is successful in avoiding the high voltage being applied to the detector, the detector has to be configured to derive a variation width of the voltage appearing across the capacitor in order to determine the end of lamp life. This scheme of detecting the lamp life end requires a rather complicated circuit arrangement with an attendant increase in manufacturing cost. Further, with the inclusion of the capacitor in series with the discharge lamp, both output terminals for the discharge lamp are always made to have a high potential relative to a ground line of the ballast circuit, which requires an additional hazard protection of avoiding electric shocks when replacing the discharge lamp.

DISCLOSURE OF THE INVENTION

In view of the above insufficiencies, the present invention has been accomplished to provide a ballast circuit for the discharge lamp which is capable of protecting the circuit when the lamp reaches its end of life with a simple and cost effective circuit arrangement, yet assuring a safe lamp replacement. The ballast circuit in accordance with the present invention comprises a DC voltage supply providing a driving DC voltage, a pair of first and second inverter switches, and a series resonant circuit generating and applying a high frequency resonant voltage to the discharge lamp. The first and second inverter switches are connected in series across the DC voltage supply and are driven to turn on and off alternately. The first inverter switches defines a high-side switch and the second inverter switch defines a low-side switch having one end connected to a ground line of the ballast circuit. The resonant circuit is composed of an inductor and a capacitor, and is connected across the second inverter switch through a blocking capacitor so as to generate the high frequency resonant voltage in response to the alternate turn on and off of the first and second inverter switches. The capacitor of the resonant circuit is adapted to be connected across the discharge lamp for applying the resonant voltage thereto. A voltage comparator is provided to detect a DC voltage appearing in the ballast circuit as a consequence of the discharge lamp reaching its lamp-life-end, and compares the detected DC voltage with a predetermined threshold and generates a lamp-life-end signal when the DC voltage exceeds the threshold. Connected to the voltage comparator is a controller which receives the lamp-life-end signal and controls the first and second inverter switches in order to reduce or stop an output power being fed to the discharge lamp. The feature of the present invention resides in that a DC sensing capacitor is connected in series with a resistor and the blocking capacitor across the second inverter switch in order to detect the DC voltage, and that the DC sensing capacitor is connected in series with the resistor and the inductor of the resonant circuit across the capacitor of the resonant circuit with one end of the DC sensing capacitor being connected to the ground line of the ballast circuit. Since the DC sensing capacitor is connected in series with the blocking capacitor outside of the resonant circuit, it can be kept free from the high voltage being generated by the resonant circuit and applied to the lamp at the start of the lamp. In this sense, the DC sensing capacitor and its associated parts have not to withstand the high voltage and therefore can be of less cost for reducing the manufacturing cost of the ballast. Further, since the DC sensing capacitor is connected in parallel with the capacitor of the resonant circuit with the one end of the DC sensing capacitor being connected to the ground line of the ballast circuit, the DC voltage detected at the DC sensing capacitor itself can directly indicate whether or not the lamp reaches the end of life, i.e., simply by comparing the DC voltage itself with the threshold and not requiring to evaluate a variation width of the detected voltage, thereby simplifying the circuit arrangement for determining the lamp life end also for reducing the manufacturing cost, in addition that the one end of the discharge lamp can be held at the ground potential for reducing safety hazard at the time of replacing the lamp.

Accordingly, it is a primary object of the present invention to provide an improved ballast circuit for operating the discharge lamp which is capable of protecting the circuit against the lamp life end condition, while reducing the manufacturing cost and assuring safe replacement of the lamp.

The ballast circuit may be designed to operate at least two discharge lamps. For this purpose, the ballast circuit includes at least two series resonant circuit each composed of an inductor and a capacitor, and connected in series with a blocking capacitor across the second inverter switch. The at least two resonant circuits are connected in parallel with each other across the second inverter switch for providing the resulting resonant voltage. The capacitor of each resonant circuit is adapted to be connected across each of the discharge lamp. Also included in the ballast circuit are at least two DC sensing capacitors each connected in series with a resistor and each of the blocking capacitors across the second inverter switch. The voltage comparator is connected to the at least two DC sensing capacitors and provide the lamp-life-end signal when the DC voltage detected at any one of the DC sensing capacitors exceeds the threshold.

In another version where at least two resonant circuits are provided to operate at least two discharge lamps, the resonant circuits are connected in series commonly with the blocking capacitor across the second inverter switch. A single DC sensing capacitor is connected in series with a resistor and the common blocking capacitor across the second inverter switch, and provided the DC voltage indicative of whether or not any one of the lamps reaches the end of life. Thus, only one DC sensing capacitor is sufficient for determination of the lamp-life-end for any one of the discharge lamps, simplifying the circuit design.

Preferably, a bypass resistor is connected in series with the blocking capacitor across the first inverter switch in order to detect the lamp-life-end due to a slow-leak of a gas from the discharge lamp. When the slow-leak occurs so that the lamp cannot sustain the operation, the bypass resistor allows the blocking capacitor to release a current through the second inverter switch, the DC voltage supply and the bypass resistor, thereby accumulating the DC voltage across the DC sensing capacitor. Thus, the lamp-life-end can be successfully detected by the presence of the DC voltage across the DC sensing capacitor.

The ballast circuit of the present invention is preferred to include an inverter controller which drives the first and second inverter switches to turn on and off at a varying frequency. In this connection, the ballast circuit may include a dimmer controller which generates a dimming signal in response to an external dimmer command, and a frequency controller which varies the frequency of the inverter controller in response to the dimmer signal for adding a dimming control of the lamp.

These and still other advantageous features of the present invention will become more apparent from the following description of the preferred embodiments when taken in conjunction with the attached drawings.

MODE FOR CARRYING OUT THE INVENTION

Figure 1:
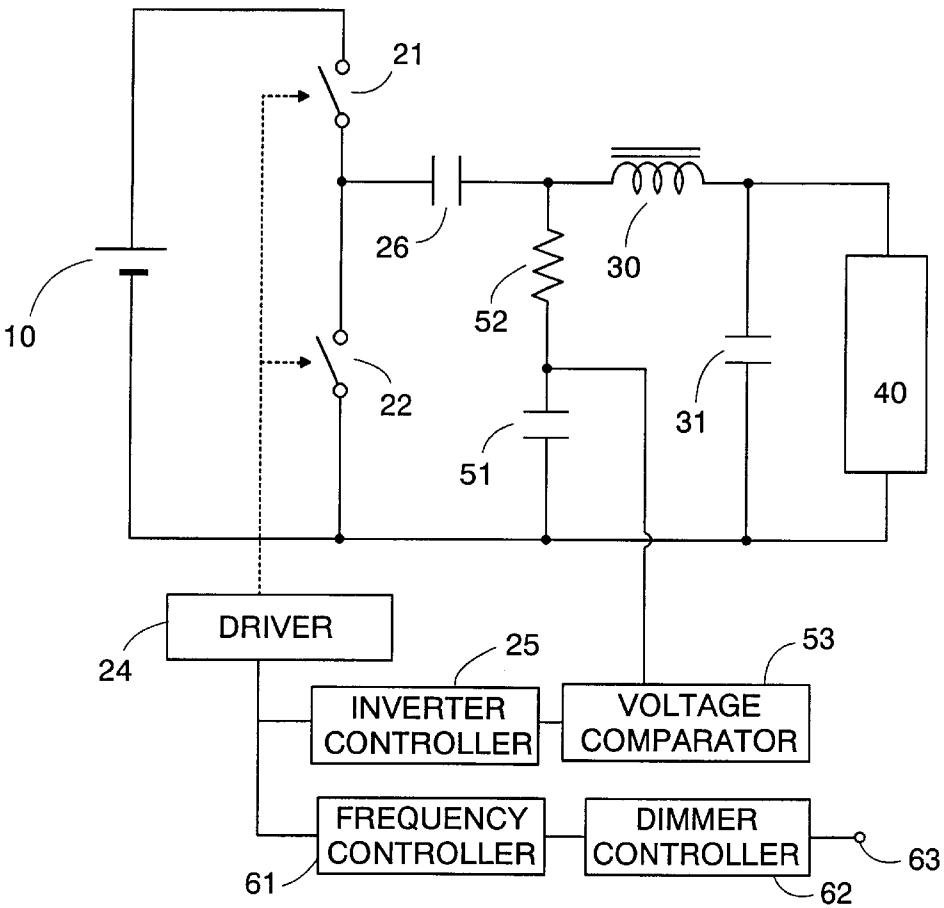
FIG. 1 is a circuit diagram of a ballast circuit for operating a discharge lamp in accordance with a preferred embodiment of the present invention.

Now referring to FIG. 1, there is shown a ballast circuit for operating a discharge lamp in accordance with a preferred embodiment of the present invention. The ballast circuit includes a DC voltage supply 10 providing a constant DC voltage, and a pair of first and second inverter switches 21 and 22 which are connected in series across the DC voltage supply 10 and are driven by a driver 24 to turn on and off alternately under the control of an inverter controller 25. The first inverter switch 11 defines a high-side switch, while the second inverter switch 12 defines a low-side switch with its one end connected to a ground line of the circuit. Also included in the circuit is a series resonant circuit composed of an inductor 30 and a capacitor 31 which are connected in series with a blocking capacitor 26 across the second inverter switch 12 with one end of the capacitor 31 connected to the ground line. It is this capacitor 31 across which the discharge lamp 40 is connected to be supplied with a high frequency resonant voltage generated by the alternate turn on and off of the first and second switches 11 and 12.

A DC sensing capacitor 51 is connected in series with a resistor 52 and the blocking capacitor 26 across the second inverter switch 12. The voltage sensed across the DC sensing capacitor 51 is fed to a voltage comparator 53 which compares the sensed voltage with one of predetermined positive and negative thresholds and gives a lamp-life-end signal when the sensed positive DC voltage exceeds the positive threshold or lowers below the negative threshold. Upon receiving the lamp life end signal from the voltage comparator 53, the inverter controller 25 responds to control the first and second inverter switches in order to lower or stop providing the output power to the discharge lamp 40.

In a normal operating condition, there appears across the DC sensing capacitor 51 an AC voltage in a square wave form symmetrical around zero volt and having a peak voltage which is ½ of the DC voltage supplied from the DC voltage source 10 when the first and second inverter switches are driven at a duty ratio of 1/2. Therefore, no DC voltage is accumulated into the DC sensing capacitor 51. The capacitor 51 and the resistor 52 may be selected to give a time constant which is sufficiently long with respect to the operating frequency of the inverter switches such that only substantially zero voltage appears across the DC sensing capacitor 51 while the circuit is in the normal operating condition.

While, on the other hand, when the lamp reaches its end-of-life due to the depletion of an emission material in the lamp 40, the lamp goes into a half-wave discharge mode. With this result, the voltage applied across the DC sensing capacitor will shift up or down with an attendant increase or decrease of the peak voltage above or below one-half of the DC voltage from the DC voltage source depending upon the direction of the half-wave discharging. Thus, the capacitor 51 is charged to accumulate the DC voltage corresponding to shifting amount of the AC voltage applied across the capacitor relative to the zero voltage level. The resulting DC voltage is compared at the comparator 53 with one of the positive and negative thresholds so that the comparator 53 issues the lamp-life-end signal indicating that the lamp reaches its end of lamp life condition. Upon occurrence of the lamp-life-end signal, the inverter controller 25 responds to restrict or cease the switching operation of the first and second inverter switches, thereby lowering or ceasing the output power being fed to the discharge lamp and therefore protecting the circuit from the excessive current which would otherwise flow through the circuit.

It is noted here that since the DC sensing capacitor 51 and the resistor 52 responsible for sensing the DC voltage are connected in circuit outside of the resonant circuit of inductor 30 and capacitor 31, these components can be substantially intact from a high voltage developed at the resonant circuit at the start of the lamp and therefore be cost effective. Further, because of that the one end of capacitor 31 which defines one terminal for connection with the lamp 40 is kept at the ground potential, the ballast circuit can be safe enough when replacing the lamp and is advantageous for home use.

The ballast circuit additionally includes a frequency controller 61 and a dimmer controller 62 which has a terminal 63 receiving an external dimmer signal of varying voltage. In response to the dimmer signal, the frequency controller 61 acts to vary the operating frequency, i.e., frequency at which the first and second inverter switches are turned on and off for dimming the lamp. In this connection, the first and second inverter switches 21 and 22 are driven at even duty ration so that, even when the operating frequency of the switches varies for the dimming purpose, the capacitance across the blocking capacitor 26 remains constant while the lamp is in the normal operation condition, enabling a consistent detection of the end of lamp life.

Figure 2:
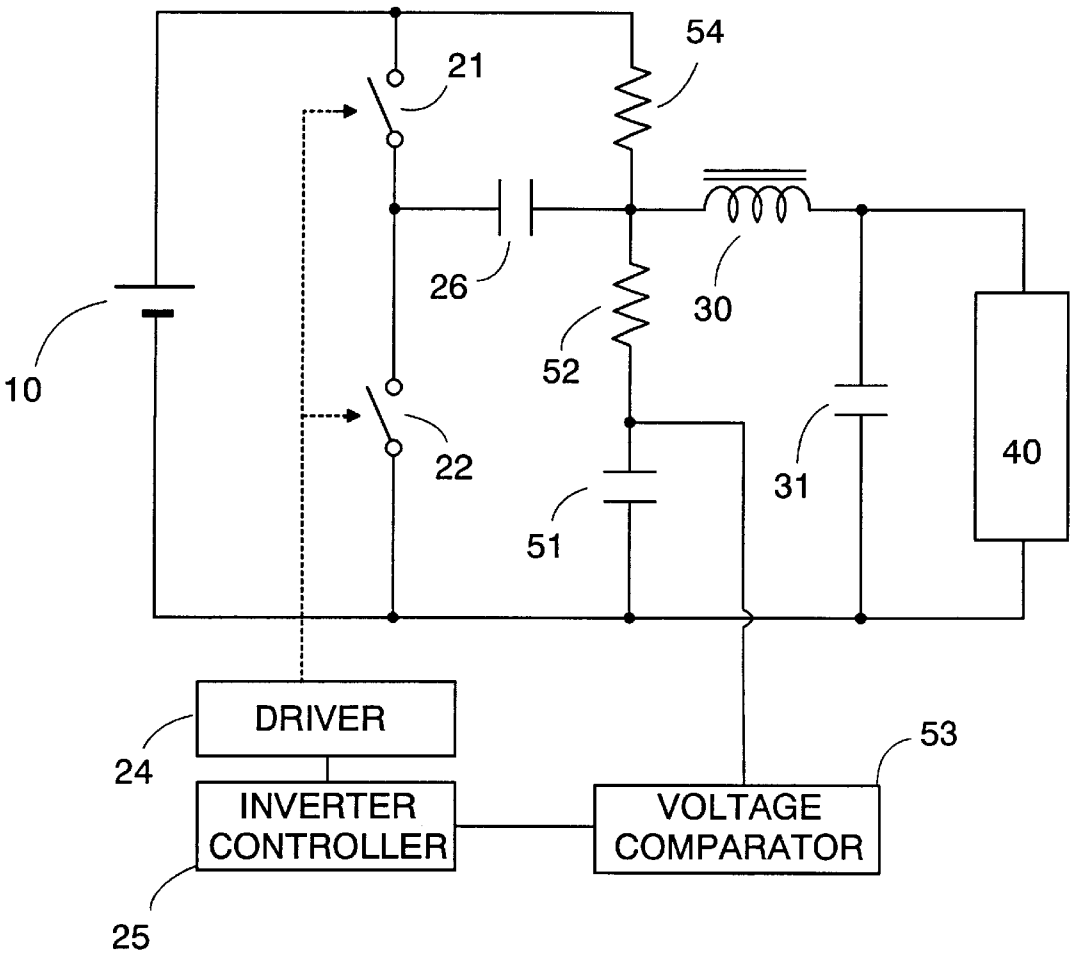
FIG. 2 is a circuit diagram of a modified ballast circuit.

FIG. 2 shows a modified ballast circuit which is identical to the above embodiment except that a bypass resistor 54 is connected in series with the blocking capacitor 26 across the first inverter switch 11 and at the same time connected in series with the resistor 52 and the DC sensing capacitor 51. The bypass resistor 54 is added for the purpose of detecting the lamp life end due to a slow leak of the lamp 40. The slow leak is typically caused by a pin-hole in the envelop of the lamp and results in not sustaining the lamp discharge. In the event of the slow leak, the blocking capacitor 26 discharges, at a timing of the second inverter switch 12 being turned on, through a path of the switch 12, the DC voltage supply 10, and the bypass resistor 54 so as to develop across the blocking capacitor 26 a DC voltage component which in turn charges the DC sensing capacitor 51 through the resistor 52. Thus, as in the half-wave discharge mode, the voltage comparator 53 responds to output the lamp-life-end signal in order to limit or stop supplying the output power for protection of the ballast circuit.

Figure 3:
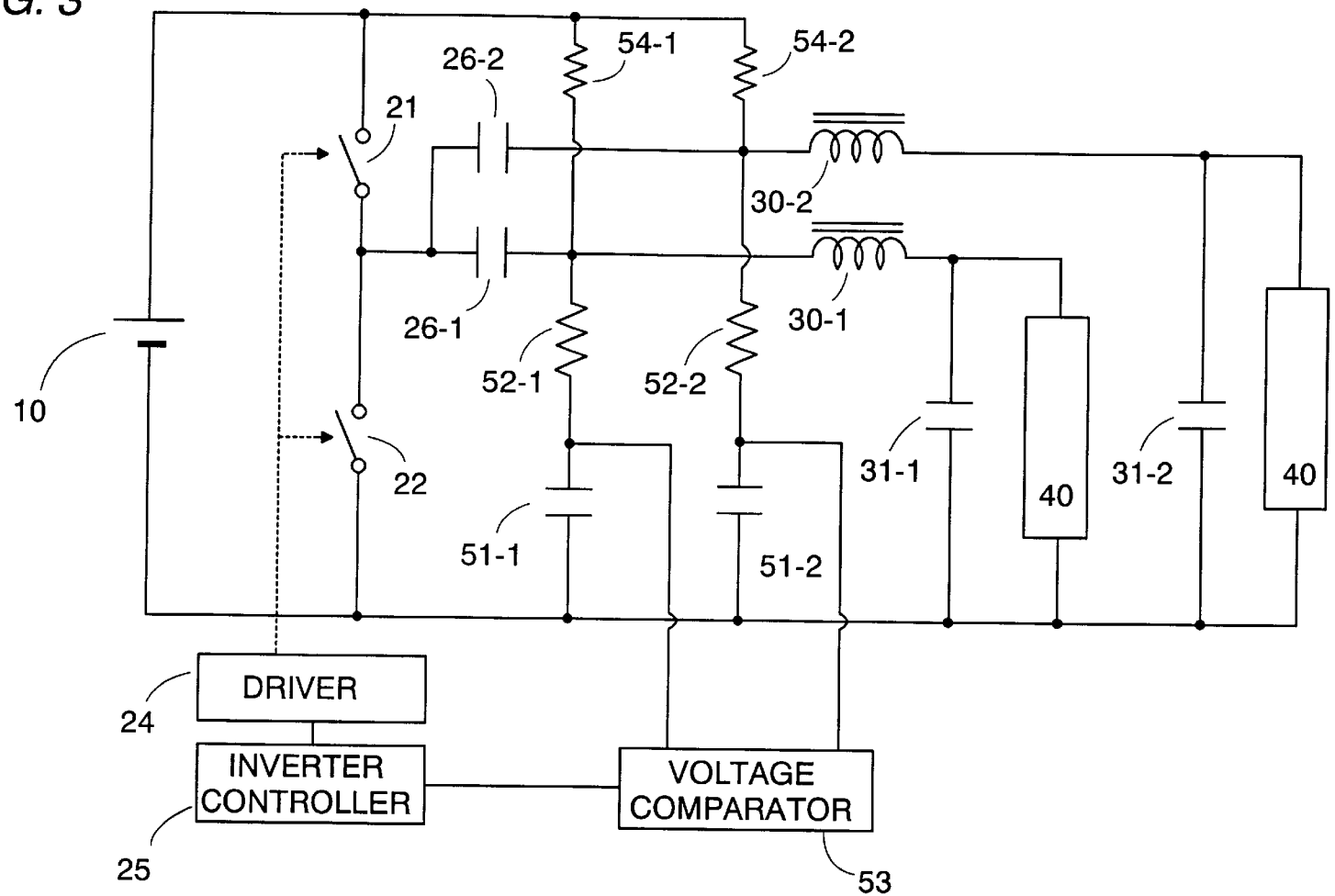
FIG. 3 is a circuit diagram of a ballast circuit in accordance with another preferred embodiment of the present invention.

FIG. 3 shows a ballast circuit in accordance with another preferred embodiment of the present invention which is similar to the above embodiment except that the circuit is designed to operate two lamps and is provided with two resonant circuits. The first resonant circuit is composed of an inductor 30-1 and a capacitor 31-1 which are connected in series with a blocking diode 26-1 across the second inverter switch 22, while the second resonant circuit is composed of an inductor 30-2 and a capacitor 31-2 connected in series with a blocking diode 26-2 also across the second inverter switch 22. The capacitors 31-1 and 31-2 are connected respectively across the lamps 40 with one ends of the capacitors being connected to the ground line. In association with the two resonant circuits, there are provided two DC voltage sensing networks each composed of a DC voltage sensing capacitor 51-1, 51-2 and a resistor 52-1, 52-2 which are connected in series with a blocking capacitor 26-1, 26-2 across the second inverter switch 22 with the DC voltage sensing capacitor having its one end connected to the ground line of the circuit. Further, for detection of the lamp life end due to the slow leak in addition to the depletion of the emission material, a bypass resistor 54-1, 54-2 is connected in series with the blocking capacitor 26-1, 26-2 across the first inverter switch 21. A voltage comparator 53 is connected to receive the voltage appearing across each of the DC sensing capacitors 51-1, 51-2 and issues the lamp-life-end signal when the DC voltage sensed at any of the capacitor exceeds the positive threshold or goes below the negative threshold. Upon receiving the lamp-life-end signal, an inverter controller 25 responds to actuate the driver 24 for limiting or ceasing the output power being fed to the lamps, thereby protecting the ballast circuit from the otherwise generated excessive current.

Figure 4:
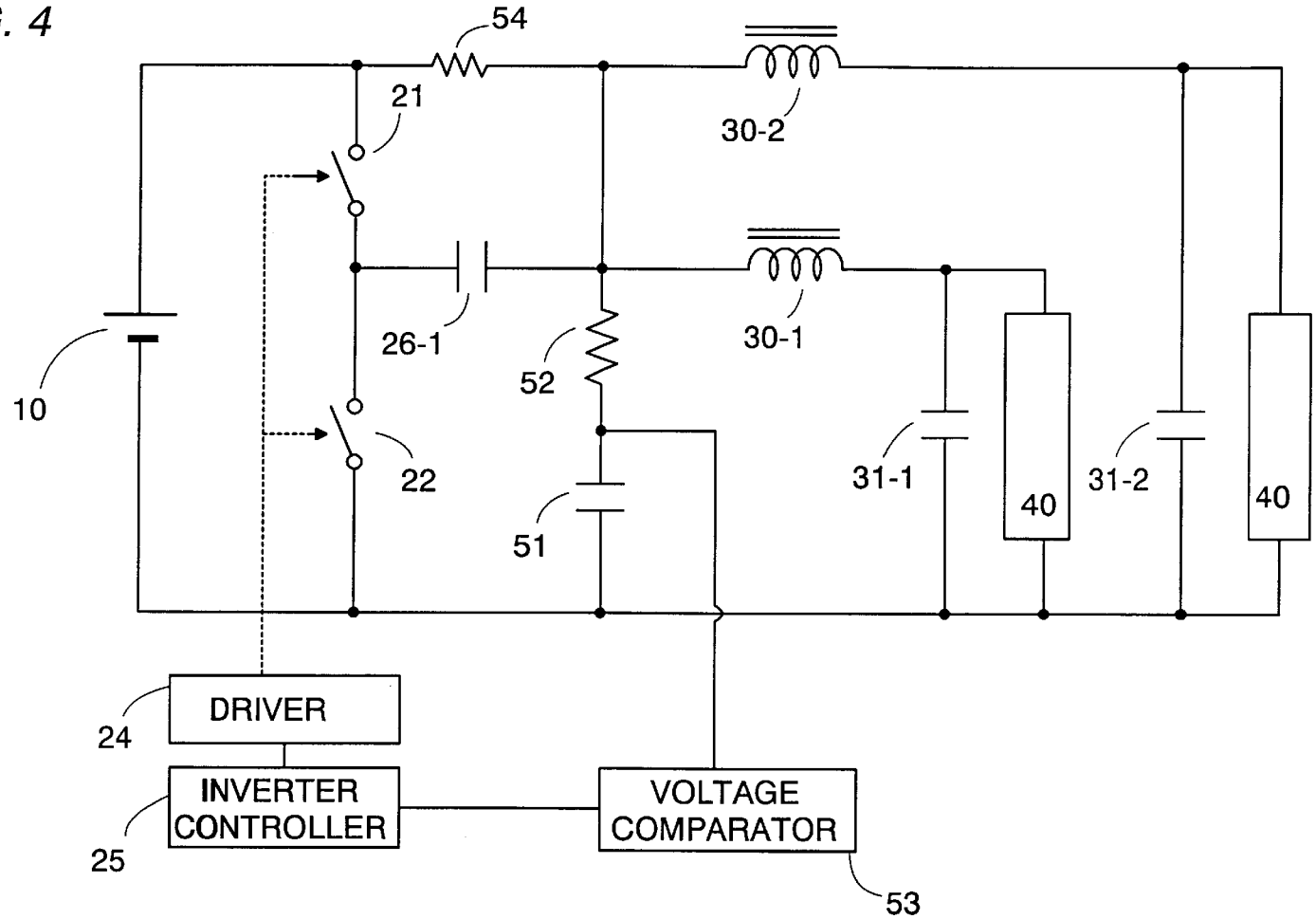
FIG. 4 is a circuit diagram of a modified ballast circuit of the embodiment of FIG. 3.

FIG. 4 shows a modified ballast circuit which is identical to the embodiment of FIG. 3 but is arranged to utilize a single DC voltage sensing network instead of the two networks in operating the two lamps 40. Like parts are designated by like reference numerals. In this modification, two resonant circuits each composed of inductor 30-1, 30-2 and capacitor 31-1, 31-2 are connected in series with the common blocking capacitor 26-1 across the second inverter switch 22, and a single DC voltage sensing network is composed of the DC sensing capacitor 51 and resistor 52 connected in series with the blocking capacitor 26-1 across the second inverter switch 22. The only one bypass resistor 54 is utilized to be connected in series with the common blocking capacitor 26 across the first inverter switch 21 in order to detect the end of lamp life due to the slow leak of the lamp. Thus, the voltage comparator 53 can detect the end of lamp life end for each of the two lamps with the use of the single DC voltage sensing network composed of capacitor 51 and resistor 52.

It should be noted that the lamp may be any suitable gas discharge lamp including a fluorescent lamp. For operating the fluorescent lamp, the ballast circuit is additionally equipped with a conventional preheating circuit for preheating the filaments of the lamp. Further, the ballast circuit of the above embodiments and modifications could be modified to operate more than two lamps which is still in the scope of the present invention. This application is based upon and claims the priority of Japanese Patent Application No. 2000-270458, filed in Japan on Sep. 6, 2000, the entire contents of which are expressly incorporated by reference herein.

What is claimed is:

1. A ballast circuit for operating a discharge lamp, said ballast comprising:

a DC voltage supply providing a driving DC supply voltage;

first and second inverter switches which are connected in series across the DC voltage supply and are driven to turn on and off alternately, said first inverter switch defining a high-side switch, and said second inverter switch defining a low-side switch having one end connected to a ground line of said ballast circuit;

a series resonant circuit composed of an inductor and a capacitor, said resonant circuit being connected across said second inverter switch through a blocking capacitor so as to generate a high frequency resonant voltage across said capacitor in response to the alternate turn on and off of said first and second inverter switches, said capacitor being adapted to be connected across said discharge lamp for applying the resonant voltage thereto;

a voltage comparator which detects a DC voltage appearing in the ballast circuit as a consequence of the discharge lamp reaching its lamp-life-end, and compares said DC voltage with a predetermined threshold to generates a lamp-life-end signal when the detected DC voltage exceeds said threshold; and a controller connected to receive said lamp-life-end signal and controlling said first and second inverter switches in order to reduce or stop an output power being fed to said discharge lamp;

wherein said ballast circuit includes a DC sensing capacitor connected in series with a resistor and said blocking capacitor across said second inverter switch in order to detect said DC voltage, and said DC sensing is connected in series with said resistor and said inductor across the capacitor of said resonant circuit, while having its one end connected to said ground line.

2. The ballast circuit as set forth in claim 1, wherein said circuit includes at least two series resonant circuits each composed of an inductor and a capacitor, and connected in series with a blocking capacitor across said second inverter switch, said at least two resonant circuits being connected in parallel with each other across said second inverter switch for providing the resulting resonant voltage to at least two discharge lamps, the capacitors of each of said series resonant circuits being adapted to be connected across each of said discharge lamp, said ballast circuit including at least two DC sensing capacitors each connected in series with a resistor and each of said blocking capacitors across said second inverter switch, and said voltage comparator being connected to said at least two DC sensing capacitors and providing the lamp-life-end signal when the DC voltage sensed at any one of the DC sensing capacitors exceeds said threshold.

3. The ballast circuit as set forth in claim 1, wherein said circuit includes at least two series resonant circuits each of which is composed of an inductor and a capacitor, and which are connected in series commonly with the blocking capacitor across said second inverter switch, said at least two resonant circuits being connected in parallel with each other across said second inverter switch for providing the resulting resonant voltage to at least two discharge lamps, the capacitors of each of said series resonant circuits being adapted to be connected across each of said discharge lamp, and said circuit including a single DC sensing capacitor which is connected in series with a resistor and said common blocking capacitor across said second inverter switch.

4. The ballast circuit as set forth in claim 1, wherein a bypass resistor is connected in series with said blocking capacitor across said first inverter switch.

5. The ballast circuit as set forth in claim 1, including an inverter controller which drives the first and second inverter switches to turn on and off alternately at a varying frequency;

a dimmer controller which, in response to an external dimmer command, generates a dimming signal; and a frequency controller which, in response to said dimming signal, varies said frequency.

* * * * *

UNITED STATES PATENT AND TRADEMARK OFFICE

CERTIFICATE OF CORRECTION

PATENT NO. : 6,696,798 B2
DATED : February 24, 2004
INVENTOR(S) : Kazuhiro Nishimoto et al.

It is certified that error appears in the above-identified patent and that said Letters Patent is hereby corrected as shown below:

Column 5,
Line 64, please change “26” to -- 26-1 --.

Signed and Sealed this

Twentieth Day of July, 2004

JON W. DUDAS
*Acting Director of the United States Patent and Trademark Office*